United States Patent [19]

Thieme

[11] 4,004,561

[45] Jan. 25, 1977

[54] IGNITION SYSTEM

[75] Inventor: Klaus-Dietrich Thieme, Wedel, Holstein, Germany

[73] Assignee: Licentia Patent-Verwaltungs-G.m.b.H., Frankfurt am Main, Germany

[22] Filed: Sept. 14, 1972

[21] Appl. No.: 288,989

[30] Foreign Application Priority Data

| | | |
|---|---|---|
| Sept. 14, 1971 | Germany | 2145790 |
| Feb. 25, 1972 | Germany | 2209006 |
| Feb. 25, 1972 | Germany | 2209007 |
| Feb. 25, 1972 | Germany | 2209008 |

[52] U.S. Cl. ..... 123/148 CB; 315/209 CD

[51] Int. Cl.[2] ..... F02P 1/00

[58] Field of Search ..... 123/148 E, 148 OC; 315/209 CD

[56] References Cited

UNITED STATES PATENTS

| | | | |
|---|---|---|---|
| 3,127,540 | 3/1964 | Collins | 123/148 E |
| 3,489,129 | 1/1970 | Issler | 123/148 E |
| 3,529,587 | 9/1970 | Sasayama | 123/148 E |
| 3,595,212 | 7/1971 | Barnes | 123/148 E |
| 3,621,826 | 11/1971 | Crestensen | 123/148 E |
| 3,636,936 | 1/1972 | Schuette | 123/148 E |
| 3,704,397 | 11/1972 | Crouch | 123/148 E |
| 3,723,809 | 3/1973 | Fujii | 123/148 E |

*Primary Examiner*—Charles J. Myhre
*Assistant Examiner*—Ronald B. Cox
*Attorney, Agent, or Firm*—Spencer & Kaye

[57] ABSTRACT

An ignition system having capacitive storage of energy required for developing ignition pulses, particularly in Otto and Wankel engines, includes a capacitive storage arrangement, a charging circuit connected between the capacitive storage arrangement and a direct current supply for charging the capacitive storage arrangement, and an ignition transformer coupled to the capacitive storage arrangement via a thyristor switching arrangement for temporarily discharging the capacitive storage arrangement through the ignition transformer to develop pulses therein for application to spark plugs or the like.

9 Claims, 10 Drawing Figures

FIG. 4
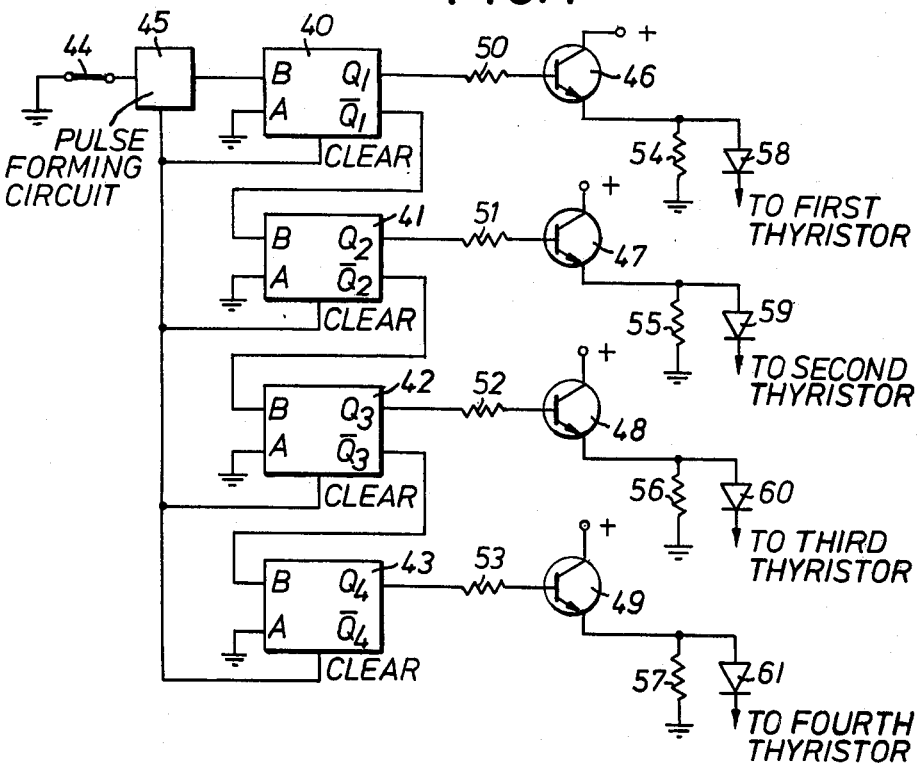
FIG. 5
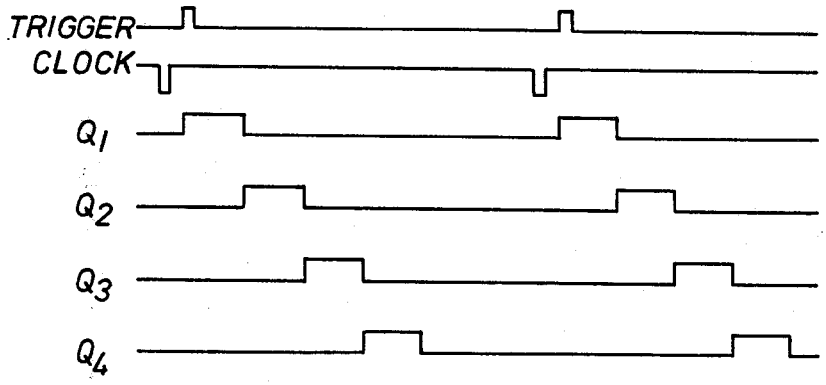
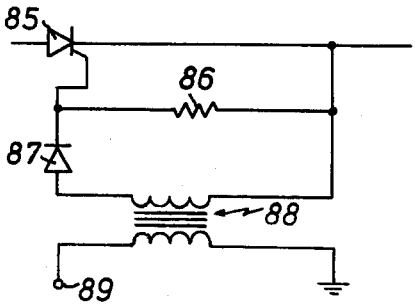
FIG. 7

IGNITION SYSTEM

BACKGROUND OF THE INVENTION

This invention relates to an ignition system having capacitive intermediate storage of the energy required for the ignition pulse. The present invention relates, more particularly, to an ignition system having a plurality of storage capacitors which are charged from a battery via a charging device, the capacitors being temporarily discharged sequentially by means of switches via an ignition transformer so as to provide an input to a spark plug. The ignition system is particularly suitable for use in conjunction with Otto and Wankel engines.

Capacitor ignition systems are known per se and are described in detail, particularly in comparison to previously generally employed coil ignition systems; see, for comparison, *Motortechnische Zeitschrift*, Vol. 24, pages 291–295 and pages 439–443 (1963) as well as *Elektronik*, Vol. 8, pages 235–238 (1966).

A comparison of the high voltage capacitor ignition systems (HVCI) and the coil ignition systems shows that the capacitor ignition systems are substantially insensitive to soiling of the spark electrodes of the spark plug and its adjacent portions which results during operation from lead, soot and combustion residues. The spark duration during discharging at the spark electrodes of the spark plug for capacitor ignition is ordinarily very short compared to the spark duration conditions for coil ignition. Whenever coil ignition is used, a series of subsequent sparks and glow periods follow the actual initial spark ignition at the spark plug, occuring at the end of the voltage rise time, when voltage across the plug is in its maximum. In such a case, even if the spark ignition occuring at the voltage peak itself were not able to cause a fuel ignition, the prepared fuel-air mixture can nevertheless be ignited by the subsequent sparks (required spark duration up to about 1400 μsec.) The known ignition with HVCI involves substantially only the initial spark and a relatively very short follow-up discharge time (about 50 μsec.). Depending on the type of engine and its operating state, individual fuel mixture ignitions may be missing because the single occurring spark between the electrodes of a spark plug will not always initiate the fuel ignition with certainty; for example, whenever the composition of the fuel-air mixture is unfavorable and/or the constituents are inhomogeneously mixed.

SUMMARY OF THE INVENTION

It is an object of the present invention to provide a high voltage capacitor ignition system in which the above-mentioned drawbacks resulting from a single triggering spark having a short firing duration are avoided.

Another object of the present invention is to provide a high voltage capacitor ignition system having increased dependability for the ignition of the fuel mixture.

These and other objects are achieved by an improved ignition system, having a capacitive storage arrangement which includes a plurality of capacitors for storing energy required for developing ignition pulses. A charging circuit is connected between each of the capacitors and a direct current supply for charging the capacitors. An ignition transformer is coupled respectively to each of the capacitors via respective thyristors.

A firing circuit is coupled to the thyristors for selectively, individually firing the thyristors during successive time intervals so as to discharge sequentially the capacitors via the ignition transformer.

A plurality of parallel connected storage capacitors and respectively associated thyristors are provided which are consecutively fired to discharge sequentially the storage capacitors.

The ignition system according to the present invention provides that a plurality of sparkovers are produced at the spark plug in rapid succession so that dependable ignition of the fuel-air mixture is assured. Depending on the time of the initiation of the discharge of the next following storage capacitor, the arc discharge across the electrodes of the plug will either already have been terminated or it will be still continuing. In the former case, a further spark ignition is produced with a subsequent arc discharge; in the latter case, the still present arc discharge remains in effect for a correspondingly extended period of time.

In practice, the effective spark duration is thus increased by the ignition system of the present invention in proportion to the number of storage capacitors, assuming that all capacitances are identical, it being a question of circuit design or advisability — as regards the engine — whether further spark ignitions are produced in the meantime. This assures that even with unfavorable fuel-air mixture conditions or operating states combustion interruptions will no longer occur. Whereas such high dependability could previously be achieved only with the dual arrangements of complete ignition systems, as for example in some Wankel and aircraft engines, the ignition system of the present invention produces satisfactory operation using an arrangement which includes a plurality of storage capacitors and switching devices, such as thyristors. Such components can today be manufactured inexpensively with relatively few structural parts.

In a preferred embodiment of the present invention an ignition pulse generator is provided which feeds pulses for the timed sequence of ignitions to the control inputs of a plurality of thyristors. This ignition pulse generator may be constituted, for example, by shift register controlled by a clock pulse generator or by a plurality of monostable flipflops which can be constructed as an integrated circuit. When monostable circuits are employed, the ignition pulse is derived via a differentiation circuit from the trailing edge of the output signal which has been, in effect, delayed by a desired time period. Alternatively, known pulse delay circuits or networks can be employed which produce second and subsequent pulses that are delayed with respect to an initial pulse, the first delay and subsequent delays being arbitrarily predetermined, as for example in a delay line.

In order to assure complete discharging of the storage capacitors and to prevent oscillation of the discharge voltage during the discharging of the storage capacitors, the present invention provides for the connection of a bypass diode in parallel with the primary winding of an ignition transformer.

It has been found, however, that during discharging of the individual storage capacitors the oscillation occurring at the primary side of the ignition transformer is strongly attenuated but that it does temporarily produce negative polarity values of the discharging voltage, in spite of the parallel connected, bypass diode.

A negative voltage pulse produced during discharging of the first storage capacitor could cause the thyristors disposed in the parallel branches and associated with the other storage capacitors to be fired at an undesired point in time. In order to assure definitely that the second and possibly subsequent storage capacitors will discharge only at the desired points in time as determined by the ignition pulse generator, the present invention provides means for preventing the firing of the thyristors during passage of the discharge voltage through the zero value. In particular, Zener diodes are provided in the control inputs of the thyristors, the diodes having a Zener voltage higher than the highest occurring negative discharging voltage. According to another preferred embodiment of the invention, thyristor firing transformers may also be provided in the control inputs of the thyristors.

The use of these measures, i.e. the placing of Zener diodes or thyristor firing transformers in the control input paths to the thyristors, it is assured that the discharges following the discharge of the first capacitor will not occur at the moment when the voltage passes through the zero point.

The passage of the discharging voltage through the zero point can be utilized, in particular preferred embodiments of the present invention, to produce a simple and inexpensive circuit arrangement for producing an ignition pulse for the thyristor of the second discharging circuit. In an ignition system having two discharging circuits, the pulse for firing the second thyristor is derived from the discharging pulse of the first discharging circuit, the control input of the thyristor of the second discharging circuit being connected to zero voltage, or reference point, of the system. In this manner a special firing pulse generator can be eliminated, the discharge of the second discharging circuit directly following the discharge of the first discharging circuit.

If a discharge of the second discharging circuit directly after the discharging of the first discharging circuit is not desired, the present invention provides another solution according to which, without any special additional means, such as Zener diodes and/or thyristor firing transformers, a firing of the thyristors by the negative values of the charging voltage at undesirable times is prevented. In this case, the cathodes of the thyristors, together with one side of the primary winding of the ignition transformer are connected to the zero reference potential of the system and the other side of the primary winding is connected to the negative polarity side of the charging device. It is assumed that the charging device, in this case, includes a transformer whose secondary and primary windings are conductively, or ohmically, isolated from one another. In this manner it is assured that the cathodes of the thyristors are always at a clear potential, i.e. zero volts, so that undesired firing of the thyristors cannot be produced at this point.

In order to reduce the power input requirement of the ignition system according to the present invention and to reduce the capacitive load on the direct voltage converter, a further preferred embodiment of the present invention provides that the storage capacitors have different dimensions so that the capacitances become smaller in the sequence of their discharge. The first discharged capacitor has the highest capacitance and the last discharged capacitor has the lowest capacitance. This is based on the consideration that the first sparkover at the spark plug will lead, if not to ignition of the fuel-air mixture, to a substantial ionization of the mixture so that the subsequent discharges at the spark plug require only little energy to ignite the fuel-air mixture.

BRIEF DESCRIPTION OF THE DRAWINGS

FIG. 4 is a schematic and block diagram of a control circuit having an arrangement of monostable multivibrators particularly useful in a preferred embodiment of the present invention.

FIG. 5 shows waveforms including a clock pulse waveform helpful in understanding the operation of the circuit of FIG. 4.

FIG. 7 is a schematic diagram of a circuit arrangement having a thyristor firing transformer in the control electrode input line of a thyristor.

DESCRIPTION OF THE PREFERRED EMBODIMENTS

Figure 1:
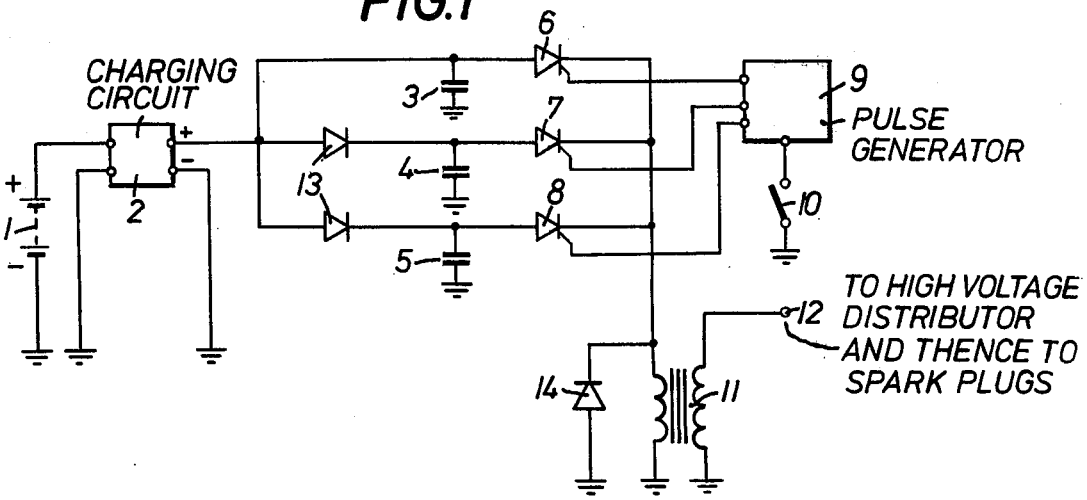
FIG. 1 is a schematic and block diagram of a high voltage capacitor ignition system having a multiple discharge circuit in accordance with the present invention.

As shown in FIG. 1, a multiple discharge circuit for an ignition system includes a battery 1, for example an automobile battery and a charging circuit 2, for example a direct voltage to direct voltage converter. The battery 1 furnishes energy for charging storage capacitors 3, 4 and 5 from the charging circuit 2. The storage capacitors 3 to 5, which are arranged in parallel branches, have respective thyristors, 6, 7 and 8 associated with them, the thyristors 6 to 8 being controlled to fire by respective outputs of an ignition pulse generator 9. This pulse generator 9 is triggered by a conventional device for example breaker points 10 or a magnetic generator.

Whenever any one of the thyristors 6 to 8 is fired the respective one of the capacitors 3 to 5 disposed in series therewith is discharged, an ignition transformer 11 being coupled between each of the storage capacitors 3 to 5 and a spark plug (not shown) as usual to convert the stored voltage on the respective storage capacitors 3 to 5 into the required firing voltage of from about 10 kv to about 30 kv. An ungrounded output terminal 12 from the secondary winding of the ignition transformer 11 leads to a so-called ignition distributor (not shown) in which conventional interrupter contacts, high voltage terminals and usually firing angle adjustment arrangements are accommodated. The other terminal of the secondary winding of the transformer 11, as well as one terminal of its primary winding, is connected to a fixed reference voltage (ground).

At the given firing time, the breaker points 10 are operated to activate the pulse timer 9, which produces a first pulse, thereby discharging the capacitor 3 by firing the thyristor 6 so that a first arc or glow discharge occurs at the spark plug which is coupled to the terminal 12 via the conventional ignition distributor. This first arc or glow discharge has a duration of substantially 50 $\mu$s.

When the spark path is extinguished, a slight amount of residual energy will produce an oscillation, however no additional sparkover occurs between the points of the spark plug. After a time interval of, for example, about 50 $\mu$s, the thyristor 7 associated with the second storage capacitor 4 is fired by a pulse from the firing pulse generator 9 so that this storage capacitor is also discharged. Consequently, a second discharge will occur between the points of the spark plug. the triggering voltage of the spark path for the discharge following the first discharge, due to the strong ionization of the fuel-air mixture by the first spark, will generally be substantially reduced. The capacitor 4 and the capacitor 5, which is subsequently discharged via the thyristor 8, may have lower capacitance, under certain circumstances, than the first capacitor 3. Since the fuel-air mixture is already ionized, the required energy for ignition of the fuel-air mixture by action of the second or third discharges can be less.

In order to prevent the first capacitor 3 from becoming charged from the other two capacitors 4 and 5 after the capacitor 3 has been discharged, the individual parallel branches associated with the capacitors 5 and 6 are coupled together and to the capacitor 3 via respective blocking diodes 13. To assure complete discharging of all the capacitors 3 to 5, and to prevent an undesired change in polarity of the voltage across the primary winding of the transformer 11, a bypass diode 14 is connected in parallel with the primary winding of the transformer 11. The transformer 11 is effective to step up the voltage applied to its primary winding to the firing voltage of from about 10 kv to about 30 kv, the high voltage appearing at the terminal 12 which is coupled to an electrode of the spark plug via the conventional ignition distributor.

In the illustrated embodiment of FIG. 1, the ignition system has three parallel-connected storage capacitors. It is to be understood, however, that the invention is not limited to systems having three storage capacitors; rather, the invention may be practiced with circuits which include only two storage capacitors or more than three storage capacitors. A control circuit specifically usable in conjunction with four storage capacitors is illustrated in FIG. 2, waveforms helpful in understanding the operation of this control circuit being shown in FIG. 3.

Figure 2:
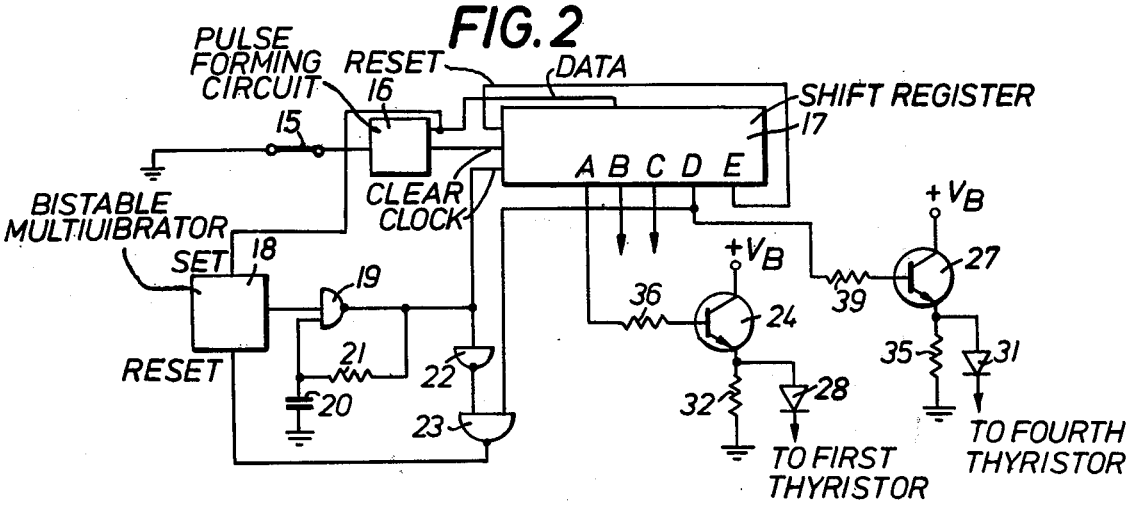
FIG. 2 is a schematic and block diagram of a control circuit including a shift register particularly useful in practicing the present invention.

In FIG. 2, a control circuit, which includes a pair of breaker points 15, corresponding to the breaker points 10 of FIG. 1, and a pulse generator, corresponding to the pulse generator 9 of FIG. 1, is illustrated in detail. The control circuit includes a firing time generator, shown as the pair of contacts 15, connected to a pulse forming circuit 16 whose DATA output signal appears as a pulse only when the pair of contacts 15 are opened and whose CLEAR output signal appears as a ONE only when the pair of contacts 15 are closed.

The CLEAR and DATA output signal terminals are connected respectively to the CLEAR and DATA input terminals of a shift register 17. The data output terminal of the pulse forming circuit 16 is also connected to the SET input terminal of a bistable multivibrator (flip-flop) 18 so that the output of the latter is set to ONE whenever the pulse forming circuit 16 supplies a ONE signal from its DATA output terminal to the SET input terminal of the bistable multivibrator 18.

The output terminal of the bistable multivibrator 18 is connected to a first input terminal of a two-input NAND circuit 19 whose other input terminal is connected to the connecting point between the free terminal of a grounded capacitor 20 and one terminal of a resistor 21. The other terminal of the resistor 21 is connected to the output terminal of the NAND circuit 19.

The circuit elements 19–21 operate as a clock pulse generator which feeds its clock pulses to the CLOCK pulse input terminal of the shift register 17, the clock pulses being produced so long as the bistable multivibrator 18 remains in the state in which it is set by the pulse signal from the DATA output terminal of the pulse forming circuit 16.

The output terminal of the NAND circuit 19 is also coupled to the input terminal of an inverter circuit 22 which has its output terminal connected to a first input terminal of a two-input NAND circuit 23. The output terminal of the NAND circuit 23 is connected to the RESET input terminal of the bistable multivibrator 18. The second input terminal of the NAND circuit 23 is connected to the fourth (D) output terminal of the shift register 17, the shift register 17 being provided with five output terminals A, B, C, D and E, the fifth terminal E being connected to the RESET input terminal of the shift register 17.

The output terminals A to D of the shift register 17 are respectively connected, via respective transistor stages 24 to 27 and respective diodes 28 to 31 (only transistors 24, 27 and diodes 28, 31 being shown) to the firing electrodes of four respective thyristors (not shown) which are operatively arranged, for example as shown in FIG. 1, to discharge sequentially four storage capacitors which, in turn, supply input signals to an ignition transformer corresponding to the ignition transformer 11 of FIG. 1.

The respective transistors 24–27 are provided with respective, emitter-to-ground resistors 32 to 35, and with respective series connected resistors 36 to 39 between their respective base electrodes and the respective output terminals A to D of the shift register 17.

It can be assumed firstly that all of the output terminals A to E of the shift register 17 have a ZERO signal appearing thereon because of the appearance initially of a ONE signal on the CLEAR input terminal of the shift register 17. Upon the opening of the pair of contacts 15, the pulse forming circuit 16 supplies a pulse signal to the DATA input terminal of the shift register 17 causing the shift register 17 to provide a ONE signal on its output terminal A. This ONE signal causes the transistor 24 to conduct and a firing pulse is supplied to the first thyristor (not shown) via the diode 28.

The pulse signal from the pulse forming circuit 16 also is fed to the bistable multivibrator 18 and sets it into a first state thereby energizing the clock pulse generator 19–21. The clock pulse generator 19–21 supplies clock pulses to the CLOCK input signal of the shift register 17 shifting the ONE signal from stage to stage of the shift register 17 so as to cause the transistors 25–27 to become conductive in sequence as a result of the sequential appearance of the ONE signal on the terminals B to D. Thus firing pulses are supplied to the second to fourth thyristors (not shown) via respective diodes (diode 31 being shown) subsequent to the firing of the first thyristor.

Upon the appearance of a ONE signal on the output terminal D, the bistable multivibrator 18 is reset by action of the NAND circuit 23 which has its second input connected to the output terminal D of the shift register 17. Thus the clock pulse generator 19–21 is turned off, its final CLOCK pulse shifting the ONE signal stored in the shift register 17 to the last stage of the shift register 17, a ONE appearing on the terminal E. Since the terminal E is connected to the RESET terminal of the shift register 17, the shift register 17 is reset and awaits another pulse from the pulse forming circuit 16.

Figure 3:
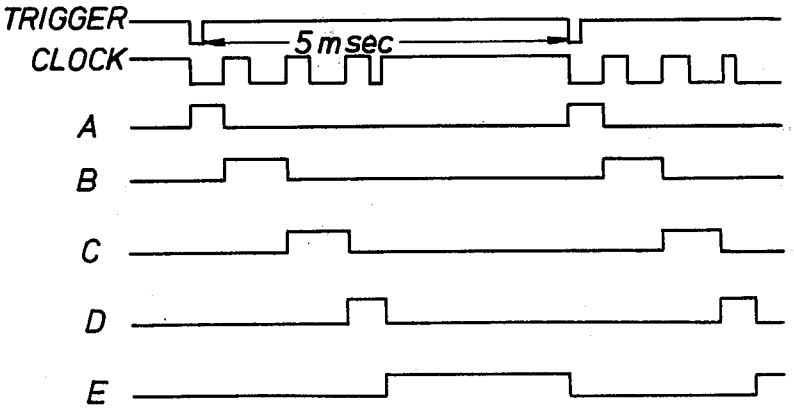
FIG. 3 shows waveforms including a clock pulse waveform used in explaining the operation of the circuit of FIG. 2.

FIG. 3 shows that, for example, every 5 msec. a firing pulse is produced by the pulse forming circuit 16 upon the opening of the pair of contacts 15 of the firing time generator. This pulse actuates the bistable multivibrator 18 to enable the clock pulse generator 19–21.

The pulse signal supplied to the DATA input of the shift register 17 sets the first stage of the shift register and a ONE signal is produced at the output terminal A. All other output terminals B to E have been set and remain for the present at ZERO. With each subsequent clock pulse from the clock pulse generator 19–21 the ONE information is shifted stage-by-stage and appears sequentially as ONE's on the terminals B to D, as can be seen in FIG. 3, only one ONE signal appearing at any time. Thus, the first to fourth thyristors (not shown) are fired in succession. If the ONE signal has reached the output terminal D of shift register 17, the clock pulse generator 19–21 is blocked via the bistable multivibrator 18 until the next firing pulse is produced by the pulse forming circuit 16.

A further possibility for controlling a plurality of, for example four, thyristors is provided by the circuit arrangement shown in FIG. 4 using a plurality of monostable multivibrators 40–43. A firing time generator, shown as a pair of contacts 44, is connected to the input of a pulse forming circuit 45. Each of the multivibrators 40–43 has its CLEAR input terminal connected to an output terminal of the pulse forming circuit 45. The respective Q outputs of the multivibrators 40–43 are connected, respectively, to respective control electrodes of transistors 46 to 49 via respective resistors 50 to 53. The emitters of the transistors 46 to 49 are connected to ground via respective resistors 54 to 57 and to respective firing electrodes of four thyristors (not shown) via respective diodes 58 to 61. When the pair of contacts 44 is opened, all the monostable multivibrators 40 and 43 are set to ZERO by the initial pulse fed to their respective CLEAR inputs, i.e. their Q outputs display ZERO signals, as shown in FIG. 5. With only a slight delay the B (data) input of the multivibrator 40 receives a trigger pulse (FIG. 5) from the pulse forming circuit 45 which pulse makes the transistor 46 conductive via the $Q_1$ output (FIG. 5) from the multivibrator 40 and thus controls the first thyristor (not shown) via the diode 58. After expiration of a given delay time, determined by an external RC circuit, the multivibrator 40 returns to its stable state and triggers the multivibrator 41 via its $\overline{Q_1}$ output. This multivibrator 41 fires the second thyristor (not shown) via the transistor 47 and diode 59. After further predetermined delay times, the third thyristor (not shown) is triggered by the $\overline{Q_2}$ and $Q_3$ outputs and the fourth thyristor (not shown) is triggered via the $\overline{Q_3}$ and $Q_4$ outputs. After this signal passage, all Q outputs of the multivibrators 40 to 43 show ZERO signals. A further clearing signal would not be required before the next firing time. However, in order to prevent faulty operating states, such as for example as a result of an absence of the operating voltage, a clearing signal pulse is preferably always again provided from the pulse forming circuit 45. As can be seen from FIG. 5, the $Q_1$, $Q_2$, $Q_3$ and $Q_4$outputs from the multivibrators 40 to 43 appear sequentially as ONE's.

The waveforms of FIG. 5 show the above-described operating states. The signal pulse first reaches all CLEAR inputs of the multivibrators 40 to 43 from the pulse forming circuit 45 and sets all of the Q outputs to ZERO. After a short delay time, which is less than 1 μsec., the multivibrator 40 receives a trigger pulse from the pulse forming circuit 45 and an output pulse of, for example, 30 μsec. appears at its $Q_1$ output as a ONE level signal. This first rectangular pulse is then followed directly by sequential $Q_2$, $Q_3$ and $Q_4$ output pulses of the ONE level from the subsequently connected multivibrators 41 to 43, which response respectively to the disappearance of the ONE level signals on the $\overline{Q_1}$, $\overline{Q_2}$, $\overline{Q_3}$ outputs of the multivibrators 40 to 42.

Figure 6:
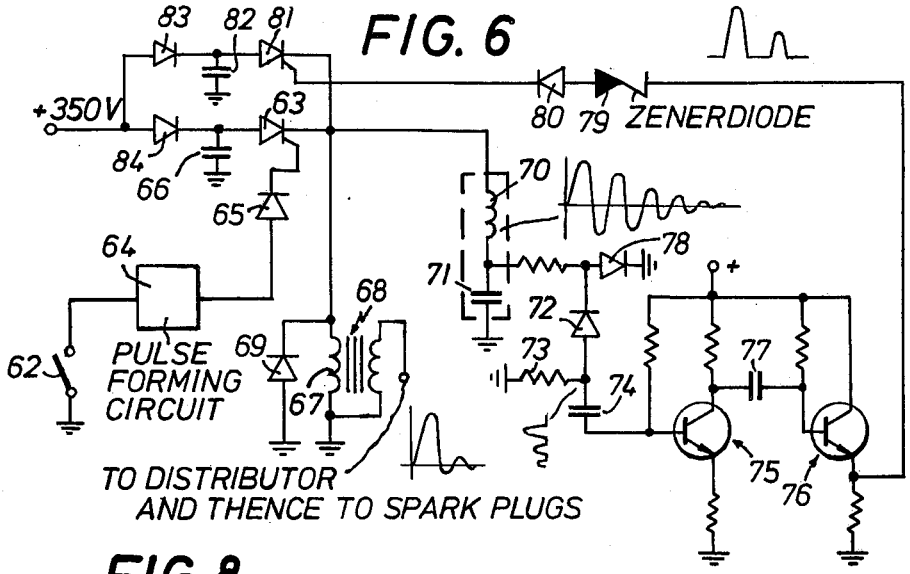
FIG. 6 is a schematic and block diagram illustrating a preferred embodiment of the present invention including a pulse delay ciruit for a firing pulse generator.

A further embodiment of an ignition system according to the present invention is shown in FIG. 6. Opening of a pair of contacts 62 of the firing time generator causes a firing pulse control signal to reach the firing electrode of a thyristor 63 from the pulse forming circuit 64 via a diode 65. The thyristor 63 conducts therby discharging a capacitor 66 via a primary winding 67 of an ignition transformer 68. A positive voltage pulse appears across the primary winding 67 of the ignition transformer 68. Oscillation is prevented by a bypass diode 69 connected across the primary winding 67. The positive pulse is fed to a series resonant circuit including a coil 70 and a capacitor 71, having a resonant frequency of, for example, 10 KHz and connected between the high side of the primary winding 67 and ground. An attenuated periodic oscillation as a result appears across the capacitor 71. The first negative half wave of this oscillation is fed via a rectifier 72 and resistor, and appears across a resistor 73 as a pulse. The pulse which appears across the resistor 73 is fed via a coupling capacitor 74 to a conventional phase-inverter amplifier 75 and thence to a conventional emitter follower 76 via a coupling capacitor 77. Positive half waves do not reach the amplifier 75 because of the action of the rectifier 72 and a diode 78 which in effect shorts positive half waves to ground.

The resulting positive pulse, which constitutes the output from the emitter follower 76, is delayed in time by about 50 μsec. by virtue of inherent delay of the circuit and is fed to the firing electrode of a thyristor 81 via a series connected zener diode 79 and diode 80. Thus a further positive voltage pulse is produced across the primary winding 67 of the ignition transformer 68 as a result of the thyristor 81 discharging a capacitor 82. In order to prevent the charge on either of the capacitors 66 and 82 from charging the other, isolating diodes 83 and 84 are connected in series with respective capacitors 82 and 66 and a 350 volt source. The circuit of FIG. 6 is relatively insensitive to interfering noise pulses, an important desirable characteristic for ignition systems. It is to be understood that if required additional time delay could be provided by appropriate delay circuit members incorporated into the circuit of FIG. 6 if needed in any particular case for firing the thyristor 81.

FIG. 7 shows another possibility for firing a thyristor, for example a thyristor 85 corresponding to the thyristor 7 in the second discharge circuit of the ignition system of FIG. 1, definitely only at the moment predetermined by the firing pulse generator. In addition to a resistor 86 and a diode 87 connected in series, both serving to protect the thyristor 85, a special thyristor firing transformer 88 is provided, its secondary being connected across the series connected resistor 86 and the diode 87. The resistor 86 is connected between the firing electrode and the cathode electrode of the thyristor 85. The transformer 88 thus conductively isolates the firing pulse generator, which is to be connected to the input terminal 89 of the primary winding of the transformer 88, from the firing electrode of the thyristor 85. This conductive isolation assures that the negative voltage pulses occurring during discharging of the first capacitor (not shown) will not lead to firing of thyristor 85.

The firing pulse generators may here be, as already mentioned, a shift register controlled by a clock pulse generator or a plurality of monostable flip-flops. When moonostable circuits are employed, the firing pulses are derived, using a differentiating circuit, from the trailing edge of output signals which has been delayed for the desired period of time. However, known pulse delay circuits and networks could also be used which produce second and subsequent firing pulses having appropriate time delays with respect to the first firing pulse which can be arbitrarily predetermined, such as in delay lines, for example.

Figure 8:
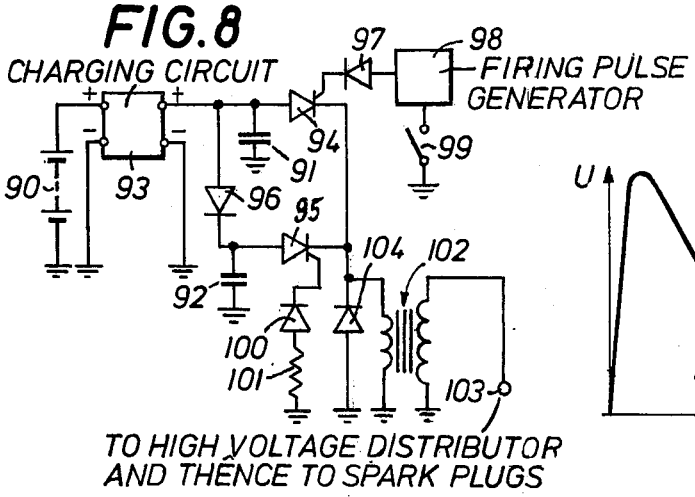
FIG. 8 is a schematic diagram of a circuit arrangement for firing a second thyristor by the discharge pulse of a first discharge circuit in accordance with a preferred embodiment of the present invention.

As shown in FIG. 8 a circuit arrangement in accordance with a preferred embodiment of the present invention includes a battery 90 for charging the storage capacitors 91 and 92 by means of a conventional charging circuit 93. The storage capacitors 91 and 92 have thyristors 94 and 95 respectively associated with them and, when triggered, effect respectively the discharging of the storage capacitors 91 and 92. A blocking diode 96 is connected ahead of the capacitor 92 to prevent its charge from partially being transferred to the capacitor 91 subsequent to its discharge.

To fire the first thyristor 94 its firing electrode is connected, via a diode 97, to the output of a firing pulse generator 98 which is triggered by the firing time generator, shown generally as a pair of contacts 99. The firing electrode of the second thyristor 95 is connected, via a diode 100 and a resistor 101, to ground, the zero reference point of the circuit. The diodes 97 and 100, which are positioned, respectively, in the control inputs to the thyristors 94 and 95 serve to protect these thyristors against the high positive peak value of the discharge voltage. The cathodes of each of the thyristors 94 and 95 are connected to ground via the primary winding of an ignition transformer 102, the high voltage output of which is developed across its secondary winding and appears at its terminal 103, which in turn is connected to a high voltage distributor (not shown). A bypass diode 104 is connected across the primary winding of the transformer 102.

The operation of a preferred circuit for the ignition system according to the present invention will be explained with the aid of FIG. 9. When the first thyristor 94 is fired by the firing pulse generator 98, which may be provided by any one of a number of known trigger circuits, preferrably operatively arranged to have negative pulse suppression, a voltage results across the primary winding of the ignition transformer 102 as it is shown by the curve 105 and the interrupted curve 106 enlarged in scale for the sake of clarity. The voltage pulse rise and the pulse duration substantially depend on the type of ignition transformer employed, stray inductance, winding capacitances and ohmic resistances being the characteristic parameters. A strongly attenuated oscillation thus results across the primary winding at which, in spite of the bypass diode, a negative voltage peak value of several volts occurs, dependent on the surge current behavior of the diode 104. In practice, the diode 104 will generally be accommodated in a switching device, separated from the ignition transformer 102 so that the resistance of the input line may also influence the oscillation amplitude.

In spite of the provision of the diode 104, there will thus temporarily result a negative value of a few volts for the discharging voltage which, however, can be utilized in a particularly advantageous manner in the circuit of FIG. 8 for firing the second thyristor 95 and thus discharging the capacitor 92 as required. If the firing electrode of the thyristor 95 is connected, as shown, via the diode 100 and the resistor 101 to ground, the electrical reference point of the circuit, the thyristor 95 is fired substantially immediately after the zero passage of the voltage oscillation produced during discharging of the first capacitor 91 so that the capacitor 92 can be discharged at the appropriate time. Thus the discharging of the second discharging circuit is effected directly after the discharging of the first discharging circuit and the voltage across the primary winding of the ignition transformer 102 will approximately correspond to the solid curves 105 and 107 shown in FIG. 9.

Figure 9:
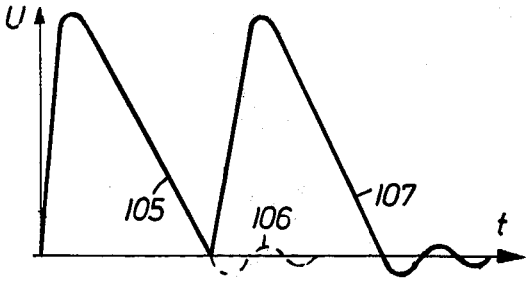
FIG. 9 shows the voltage waveform on the primary side of the ignition coil illustrated in the circuit of FIG. 8.

As can be seen from the foregoing discussion relative to FIGS. 8 and 9, with a minimum of effort an ignition system according to the present invention can be used to approximately double the effective voltage application period as compared to the conventional capacitor ignition systems.

Figure 10:
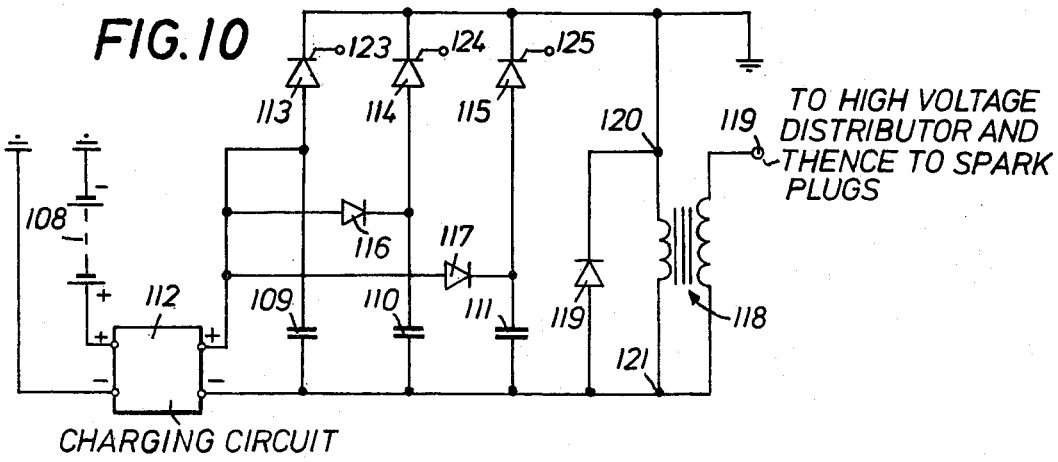
FIG. 10 is a schematic and block diagram illustrating a preferred embodiment of the present invention including an ignition circuit having thyristor cathodes connected to ground.

FIG. 10 illustrates a preferred embodiment of the present invention having the grounded negative pole of a battery 108 as its reference point. Energy is taken from the battery 108 for charging three storage capacitors 109, 110 and 111. The charging is effected by means of a conventional charging circuit 112. The charging circuit 112 includes a transformer for producing the required voltage of several hundred volts, using conductively isolated primary and secondary windings.

The storage capacitors 109, 110 and 111 have associated respectively with them thyristors 113, 114 and 115 whose firing causes these storage capacitors 109, 110 and 111 to be respectively discharged.

The storage capacitors 109 to 111 are each connected between the negative output terminal and the positive terminal of the charging circuit 112, and blocking diodes 116 and 117 are disposed respectively in the input leads to the capacitors 110 and 111. A bypass diode 119 is further connected in parallel with the primary winding of an ignition transformer 118, which primary winding is connected in series with the cathode-anode paths of each of the thyristors 113 to 115.

The cathodes of thyristors 113, 114 and 115 are each connected to ground, the reference point of the system, as well as to a first terminal 120 of the primary winding of the ignition transformer 118, i.e. are at zero potential. The other terminal 121 of the primary winding is connected to the negative output terminal of the charging circuit 112. The negative terminal of the charging circuit 112 is substantially isolated with respect to the reference potential of the system because of the transformer (not shown) employed therein. The cathodes of thyristors 113 and 115 thus lie at an unchanging zero potential (ground) and undesired firing of these thyristors by a negative voltage pulse on the cathode side cannot occur.

The ignition transformer 118, as in the previously-described embodiments, is substantially charged with positive voltage pulses during the discharging of the capacitors 109 to 111. Only the first terminal 120 of the primary winding of the ignition transformer 118 is connected with the reference point which is of no significance for the operation of the ignition transformer 118. Thus a discharging process produces the desired negative high voltage pulses at terminal 122 with respect to the reference point.

The respective firing electrodes 123, 124 and 125 of the respective thyristors 113 to 115 receive a succession of pulses for firing, the firing pulses being furnished by the firing pulse generator (not shown) as shown, for example, in FIG. 1.

It is, however, also within the scope of the present invention to connect instead only two storage capacitors in parallel. The idea of the invention is to produce a plurality (at least two) of consecutive spark heads in order to increase the firing dependability particularly under otherwise unfavorable operating conditions, such as a partial load and/or at higher revolution rates.

It will be understood that the above description of the present invention is susceptible to various modifications, changes and adaptations, and the same are intended to be comprehended within the meaning and range of equivalents of the appended claims.

I claim:

1. In a high voltage capacitor ignition system having capacitive storage means for storing energy required for developing fuel ignition pulses for the spark plugs of an engine, the system further including charging circuit means connected between the capacitive storage means and a battery for charging the capacitive storage means, ignition transformer means, and switching means coupled between the capacitive storage means and the transformer means for temporarily discharging the capacitive storage means via the transformer means to develop pulses therein for application to each such spark plug in succession, the improvement wherein: said capacitive storage means comprise a plurality of capacitors each connected to receive charging current from said charging circuit means; and said switching means comprise a plurality of thyristors each coupled between a respective one of said capacitors and a common input of said transformer means and arranged to be fired at successive time intervals to discharge said capacitors in succession to apply a succession of fuel ignition pulses to each spark plug, the succession of pulses thus establishing an effective fuel ignition spark duration proportional to the number of said capacitors, each of said thyristors including a firing electrode and a pair of current-carrying electrodes, and said switching means further comprising firing pulse generator means including a clock pulse generator for producing a plurality of successive clock pulses, and means, including shift register means having a clock pulse input operatively coupled to said clock pulse generator means for receiving the clock pulses produced thereby, for feeding each of the successive pulses to the firing electrode of a respective one of said thyristors so that each of said thyristors is fired in turn.

2. An arrangement as defined in claim 1, wherein said ignition transformer means comprises: an ignition transformer having a primary winding and a secondary winding, said primary winding being connected in series with each thyristor of said plurality of thyristors; and a bypass diode connected in parallel with said primary winding.

3. An arrangement as defined in claim 1, wherein each of said capacitors has a capacitance which is smaller than those of the capacitors which are connected to be discharged ahead of it.

4. In a high voltage capacitor ignition system having capacitive storage means for storing energy required for developing fuel ignition pulses for the spark plugs of an engine, the system further including charging circuit means connected between the capacitive storage means and a battery for charging the capacitive storage means, ignition transforming means, and switching means coupled between the capacitive storage means and the transformer means for temporarily discharging the capacitive storage means via the transformer means to develop pulses therein for application to each spark plug in succession, the improvement wherein: said capacitive storage means comprise a plurality of capacitors each connected to receive charging current from said charging circuit means; and said switching means comprise a plurality of thyristors each coupled between a respective one of said capacitors and a common input of said transformer means and arranged to be fired at successive time intervals to discharge aid capacitors in succession to apply a succession of fuel ignition pulses to each spark plug, the succession of pulses thus establishing an effective fuel ignition spark duration proportional to the number of said capacitors, each of said thyristors including a firing electrode and a pair of current-carrying electrodes, and said switching means further comprising firing pulse generator means composed of a plurality of monostable multivibrators for producing a plurality of successive pulses and means for feeding each of the successive pulses to the firing electrode of a respective one of said thyristors so that each of said thyristors is fired in turn.

5. In an ignition system having capacitive storage means for storing energy required for developing ignition pulses for the spark plugs of an engine, the system further including charging circuit means connected between the capacitive storage means and a battery for charging the capacitive storage means, ignition transformer means, and switching means coupled between the capacitive storage means and the transformer means for temporarily discharging the capacitive storage means via the transformer means to develop pulses therein for application to the spark plugs, the improvement wherein: said capacitive storage means comprise a plurality of capacitors each connected to receive charging current from said charging circuit means; and said switching means comprise a plurality of thyristors each coupled to a respective one of said capacitors and arranged to be fired at successive time intervals to discharge said capacitors in succession, each of said thyristors including a firing electrode and a pair of current-carrying electrodes one of which is a cathode via which said thyristor is coupled to its respective capacitor, said cathode and said firing electrode of each said thyristor defining its control input means, and firing prevention means connected to each said control input means for preventing the firing of each said thyristor during negative passages of the discharge voltage applied to its cathode.

6. An arrangement as defined in claim 5, wherein each of said firing prevention means comprises a Zener diode connected in series with the firing electrode of its respective thyristor and having a Zener discharge voltage which is higher than the voltage occurring subsequent to the zero passage of the firing voltage applied thereto.

7. An arrangement as defined in claim 5, wherein each of said firing prevention means comprises transformer means coupled to said control input means.

8. In a high voltage capacitor ignition system having capacitive storage means for storing energy required for developing fuel ignition pulses for the spark plugs of an engine, the system further including charging circuit means connected between the capacitive storage means and a battery for charging the capacitive storage means, ignition transformer means, and switching means coupled between the capacitive storage means and the transformer means for temporarily discharging the capacitive storage means via the transformer means to develop pulses therein for application to each such spark plug in succession, the improvement wherein: said capacitive storage means comprise two capacitors each connected to receive charging current from said charging circuit means; said switching means comprise two thyristors each coupled between a respective one of said capacitors and a common input of said transformer means and arranged to be fired at successive time intervals to discharge said capacitors in succession to apply a succession of fuel ignition pulses to each spark plug, the succession of pulses thus establishing an effective fuel ignition spark duration proportional to the number of said capacitors; said system further comprises means connected between said thyristors and responsive to the firing of the first of said thyristors for developing a firing pulse for firing the second of said thyristors; and said system is provided with an electrical zero reference point, and said second thyristor is provided with a control input means connected to said reference point.

9. In an ignition system having capacitive storage means for storing energy required for developing ignition pulses for the spark plugs of an engine, the system further including charging circuit means connected between the capacitive storage means and a battery for charging the capacitive storage means, ignition transformer means, and switching means coupled between the capacitive storage means and the transformer means for temporarily discharging the capacitive storage means via the transformer means to develop pulses therein for application to the spark plugs, the improvement wherein: said capacitive storage means comprise a plurality of capacitors each connected to receive charging current from said charging circuit means; said switching means comprise a plurality of thyristors each coupled to a respective one of said capacitors and arranged to be fired at successive time intervals to discharge said capacitors in succession; and said system has a point of zero reference potential, each of aid thyristors includes a cathode, said ignition transformer means includes a primary winding having two terminals, said charging circuit means includes a negative terminal, and each of said cathodes is connected to said point of zero reference potential and to one of said two terminals of said primary winding and the other of said two terminals is connected to said negative terminal.

* * * * *